US006186369B1

(12) United States Patent
Rosenthal

(10) Patent No.: US 6,186,369 B1
(45) Date of Patent: Feb. 13, 2001

(54) PUMP

(75) Inventor: Karl-Heinz Rosenthal, Reichshof/Oberagger (DE)

(73) Assignee: INNOCOS Innovative Verpackungen für die kosmetische Industrie GmbH (DE)

( * ) Notice: Under 35 U.S.C. 154(b), the term of this patent shall be extended for 0 days.

(21) Appl. No.: 09/297,524

(22) PCT Filed: Oct. 27, 1997

(86) PCT No.: PCT/DE97/02508

§ 371 Date: May 3, 1999

§ 102(e) Date: May 3, 1999

(87) PCT Pub. No.: WO98/19796

PCT Pub. Date: May 14, 1998

(30) Foreign Application Priority Data

Nov. 4, 1996 (DE) ..... 196 45 393

(51) Int. Cl.[7] ..... B65D 88/54
(52) U.S. Cl. ..... 222/321.7; 222/340
(58) Field of Search ..... 222/321.1, 321.7, 222/340, 321.6, 321.2, 321.9

(56) References Cited

FOREIGN PATENT DOCUMENTS 2902624 1/1979 (DE) .

3246105 12/1982 (DE) .

*Primary Examiner*—Kevin Shaver
*Assistant Examiner*—Melvin A. Cartagena
(74) *Attorney, Agent, or Firm*—Diller, Ramik & Wight

(57) ABSTRACT

On order to simplify the design of a pump intended for use with flowable elements, especially a cosmetic pump provided with a base plate (1) which can be secured to a container (2) and presents, once mounted, a lower side (6) turned to the container and an upper side (7) turned in the opposite direction, with an inlet (14) for letting through the element stored in the container (2) and, around the inlet on the upper surface, a sleeve for receiving a pumping device with a cover-fitted piston (21), which is pushed by at least one compression spring against the base plate (1), while said piston cover has a lower side (21*a*) turned to the container (2), an upper side (21*b*) turned in the opposite direction and an outlet (23), while said lower side (21*a*) is provided with a sealing sleeve (22) mounted moveable in a substantially axial direction, it is suggested that the pumping device should be fitted with a valve spring (4) presenting a sealing bottom plate (20) laid on the inlet in the base plate and a sealing top plate (31) laid on a support emerging radially relative to the longitudinal axis (20, 50) of the pump, while both the bottom plate (30) and the top plate (31) are linked by at least one spring element.

29 Claims, 10 Drawing Sheets

PUMP

BACKGROUND OF THE INVENTION

Figure 1:
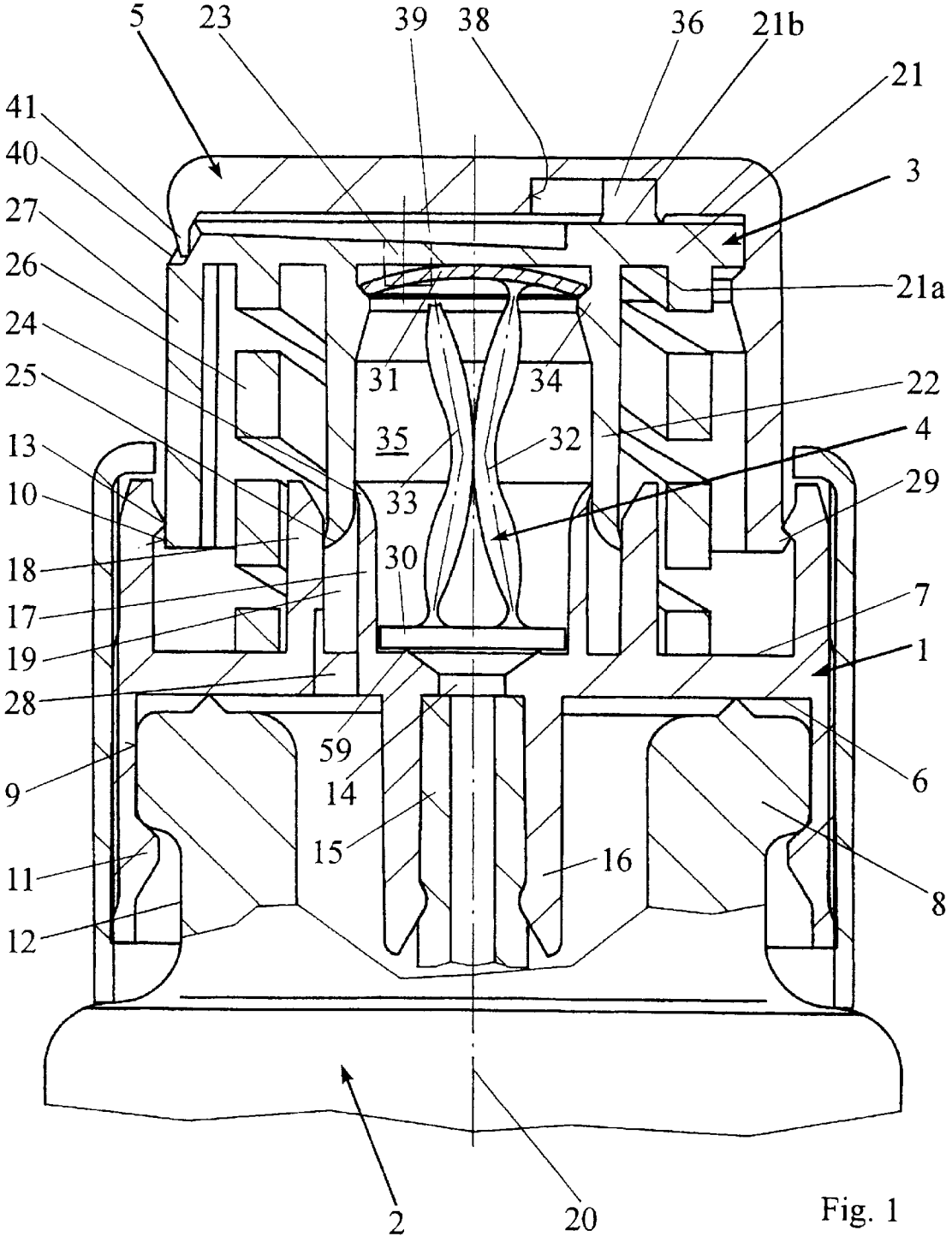

The invention concerns a pump intended for use with flowable media, especially a cosmetic pump, provided with a base plate which can be secured to a container and presents, once mounted, a lower side turned to the container and an upper side turned in the opposite direction, with an inlet for letting through the medium stored in the container and, around the inlet on the upper surface, a sleeve for receiving a pumping device with a cover-fitted piston, which is pushed against the base plate by at least one compression spring, while said piston has a lower side turned to the container, an upper side turned in the opposite direction and an outlet, while said lower side is provided with a sealing sleeve mounted moveable in a substantially axial direction.

A known pump of the type described is known to the applicant from prior art available within the company. The pump comprises a steel ball, which can be positioned on the inlet in the base plate to form a seal and which is pressed into or onto the inlet in the base plate by two helical springs which can be clamped below the lower side of the piston. As a rule, intermediate elements are inserted between the individual helical springs in this context, in order to improve the guidance of the springs. Packing rings are used to form a seal between the piston and a cap which can be mounted on it and serves to simplify operation of the piston. As a rule, a pump known from the prior art consists of 7 to 8 different components. As many of the components as possible are preferably made as injection-moulded plastic parts and fastened on a neck of the container.

Comparable pumps are known from DE 32 46 105 and DE 29 02 624.

These pumps have various drawbacks. On the one hand, their assembly is time-consuming and expensive, as several components, which are additionally made of different materials, have to be accurately connected to one another in order to guarantee perfect operation of the pump. A certain minimum overall height of the pump is necessary owing to the number of components. As a result of this relatively tall design, a major portion of the pump reaches up into the upper bottle neck. This is a disadvantage, particularly in view of the increasing use of transparent containers, as this part of the pump spoils the overall aesthetic impression. In addition, a sufficiently large opening is required in order to insert the pump into the container. On the other hand, these components cannot be transferred to the area above the bottle neck without further ado, as there are again certain restrictions regarding the overall height.

SUMMARY OF THE INVENTION

Consequently, the object of the present invention is to simplify the design of the generic pump.

According to the invention, this object is solved in that the pumping device has a valve spring which is provided with a sealing bottom plate which can be laid on the inlet in the base plate and a sealing top plate which can be laid on a support of the sealing sleeve emerging essentially radially relative to the longitudinal axis of the pump, where the bottom plate and the top plate are linked by at least one spring element. The bottom plate is expediently designed as a disk valve.

The design of the valve spring is particularly simple. It preferably consists of a single component which is inserted between the sealing sleeve and the base plate sleeve during assembly.

No attention need be paid to the accurate fit and seating of several components relative to one another. This reduces the manufacturing costs. Moreover, the valve spring offers the opportunity of substantially reducing the overall height. The entire pumping device can be located in the area above the base plate, meaning that no components have to project into the container neck. This makes it possible also to use containers having an opening with a very small cross-section, which were previously unsuitable for the use of a pump.

The compression spring is preferably located between the lower side of the piston and the upper side of the base plate, on the side of the sealing sleeve and the base plate sleeve facing away from the centre line of the pump. This prevents the compression spring from coming into contact with the sealing sleeve or the base plate sleeve when the pump is operated.

It is particularly advantageous for simple and low-cost manufacturing and assembly if the compression spring is integrally moulded on the piston. This reduces the absolutely necessary number of components to four, as the pump then only comprises the base plate, the piston, the valve spring and the cap, although the cap is not an absolutely necessary component.

Particularly good guidance of the sealing sleeve is achieved if the upper side of the base plate displays a guide sleeve, which is integrally moulded on the base plate at a distance from the base plate sleeve in the direction facing away from the centre line of the pump, and the sealing sleeve engages between the base plate sleeve and the guide sleeve. However, if the pump is to be of particularly simple design, it is also possible for the sealing sleeve to engage the inner side of the base plate sleeve to form a seal and for no guide sleeve to be provided.

In order to enhance the sealing effect, the base plate sleeve has a lip seal which lies against the inner side of the sealing sleeve to form a seal. This means that additional packing rings can also be dispensed with.

For the same reason, the outer side of the sealing sleeve also preferably displays a lip seal which can be laid against the inner side of the guide sleeve to form a seal. The lip seals are preferably located on the top edges of the sleeves, although they can also be arranged in different positions, depending on the application.

In the case of a pump designed as an air-aspirating system, at least one inlet aperture is provided for ambient air, this inlet aperture being designed as an air aperture located on the side of the base plate sleeve facing away from the inlet in the base plate, through which air can flow into the container. However, the pump according to the invention can also be designed as an airless system, in which case the air aperture is dispensed with.

The air aperture is preferably located between the base plate sleeve and the guide sleeve. The sealing sleeve then acts as a control valve to regulate the entry of air into the container. Air can flow into the container when the pump is depressed to such a point that the sealing edge of the sealing sleeve enters the air aperture and there is thus no longer a seal between the sealing sleeve and the guide sleeve.

For using the pump in connection with liquid media, where the pump has an integrally moulded duct on the piston for guiding the medium out of the pump through an outlet aperture, the duct is designed in such a way that the flow velocity of the medium is increased. The duct is preferably integrated in the piston cover and is provided with a least one ring-shaped segment which displays a reduced cross-section at at least one point. The ring-shaped segment acts as an acceleration chamber, in which the flow velocity of the medium is greatly increased as a result of the centrifugal force.

The duct can also display a linear segment, where the cross-section of the linear segment decreases in the direction of flow of the medium. This nozzle-type design likewise increases the flow velocity of the medium. The duct can display both an arc-shaped and a linear segment, which merge into each other in order to combine their effects. Depending on the field of application, it is also possible to provide an alternating arrangement of several different segments.

The duct can additionally display a deflector wall running essentially perpendicular to the direction of flow of the medium flowing through the duct. The medium is atomised when it hits this baffle wall.

In order to further reduce the overall height, it is possible, in the case of a pump operated by means of a cap fitted on the piston, to integrally mould at least part of the duct in the cap, so that the duct is formed between the cap and the piston.

The cap is preferably provided with an elastic sealing lip located on the outlet aperture to seal off the outlet aperture when the pump is not in use. In this way, the medium is protected against ambient influences and against drying out. It is particularly advantageous if this sealing lip is integrally moulded on the cap. When the pump is used, the elastic sealing lip is forced aside by the pressure of the medium, allowing the medium to escape. At the same time, the sealing lip causes atomisation of the medium in the case of liquid media.

In a version of the pump according to the invention which is designed as a lotion pump, the piston and the cap form an aperture, in the form of a slit-type nozzle for instance, as a result of the adjacent area at the outlet aperture. The slit-type nozzle thus formed in the area between piston and cap is considerably easier to manufacture than the slit-type nozzles known from the prior art, the manufacture of which requires compliance with very close tolerances and which are highly susceptible to wear as a result. In the slit-type nozzle according to the invention, two prefabricated parts, i.e. the cap and the piston, are simply assembled without having to pay attention to any special tolerances.

In order to further simplify manufacture, the bottom plate and the top plate are connected by two torsion springs which are integrally moulded to the bottom plate and the top plate. Alternatively, other types of spring, such as flat spiral springs, can also be used.

In the preferred configuration, the valve spring displays two torsion springs, which are offset relative to each other and integrally moulded on the top plate. This design ensures that the torsion springs do not interfere with each other when loaded and slide past each other when they bend. In terms of manufacturing, this design has the additional advantage that a split mould with two followers can be used, meaning that the valve spring can easily be removed from the mould after injection.

The top plate preferably has a smaller outside diameter than the inside diameter of the sealing sleeve in the area above the support. This design ensures that the medium can escape. Moreover, the top plate is arched towards the side facing away from the base plate, this guaranteeing the necessary pretension for proper functioning between the upper point of contact of the top plate on the lower side of the piston and the lower point of contact of the top plate on the support.

The base plate, piston, cap and valve spring are preferably made of one material. This also facilitates disposal.

An example of the device is illustrated in the drawing and explained in detail below based on the figures.

DESCRIPTION OF THE PREFERRED EMBODIMENTS

Figure 2:
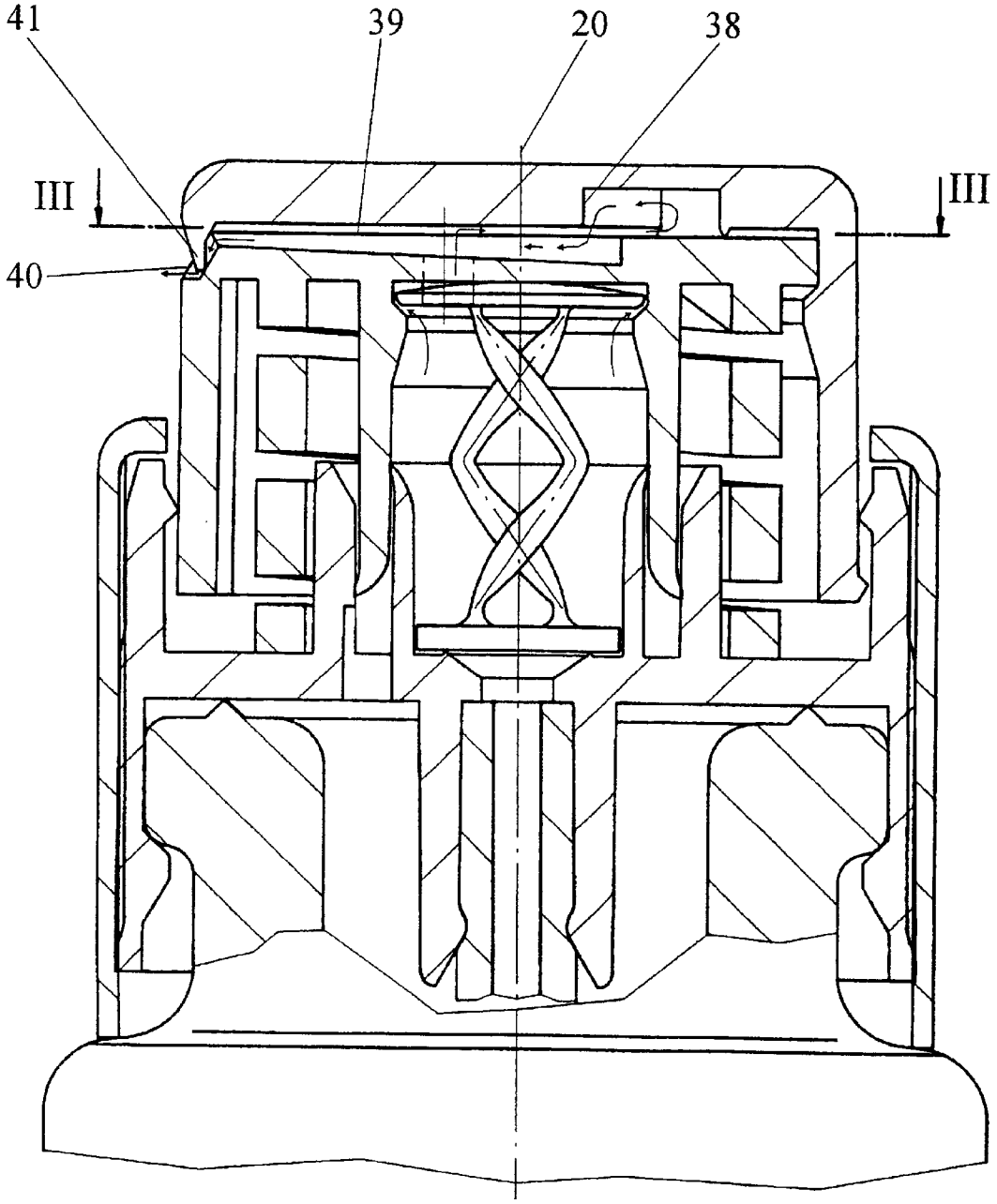
Figure 3:
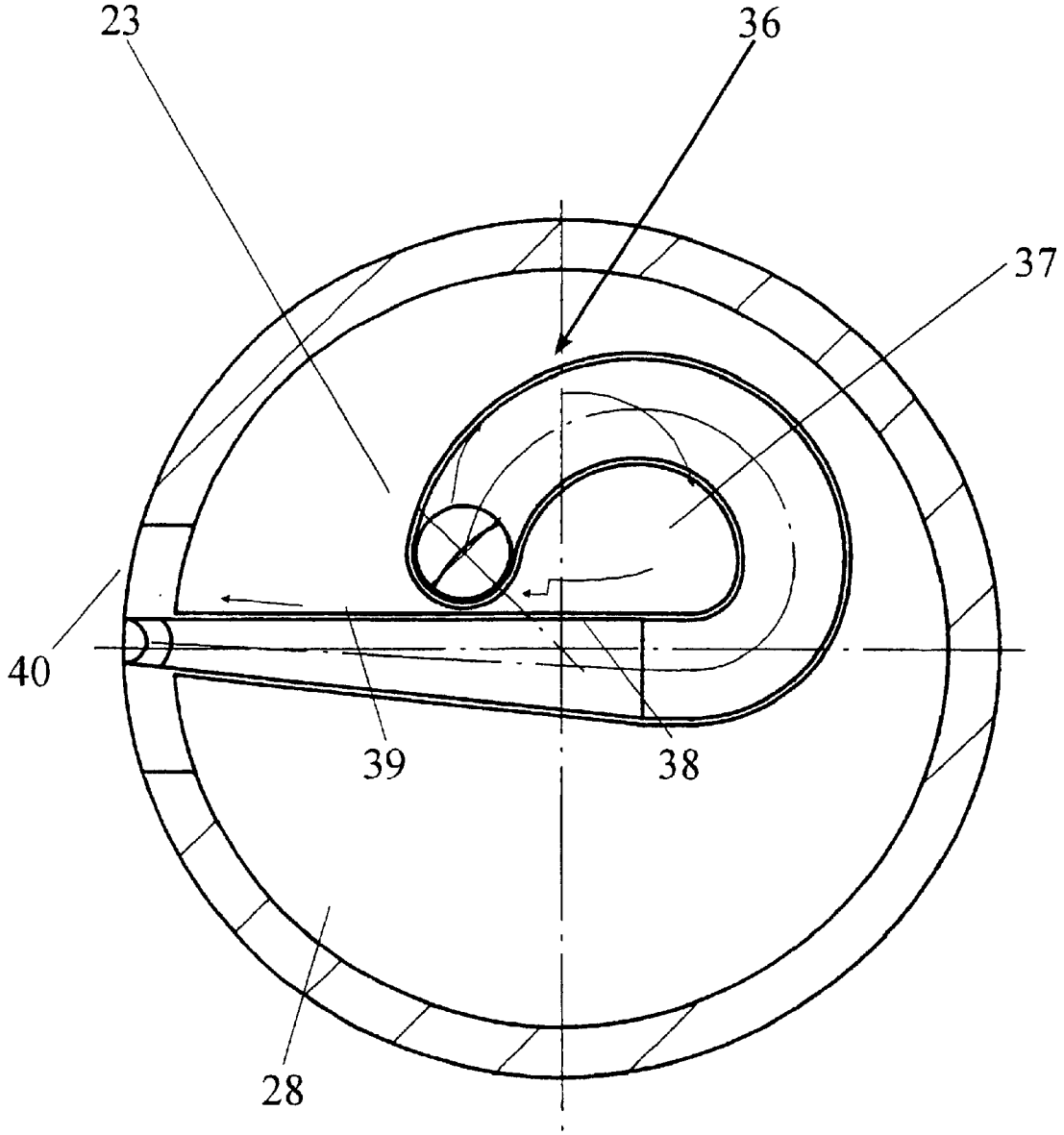
Figure 4:
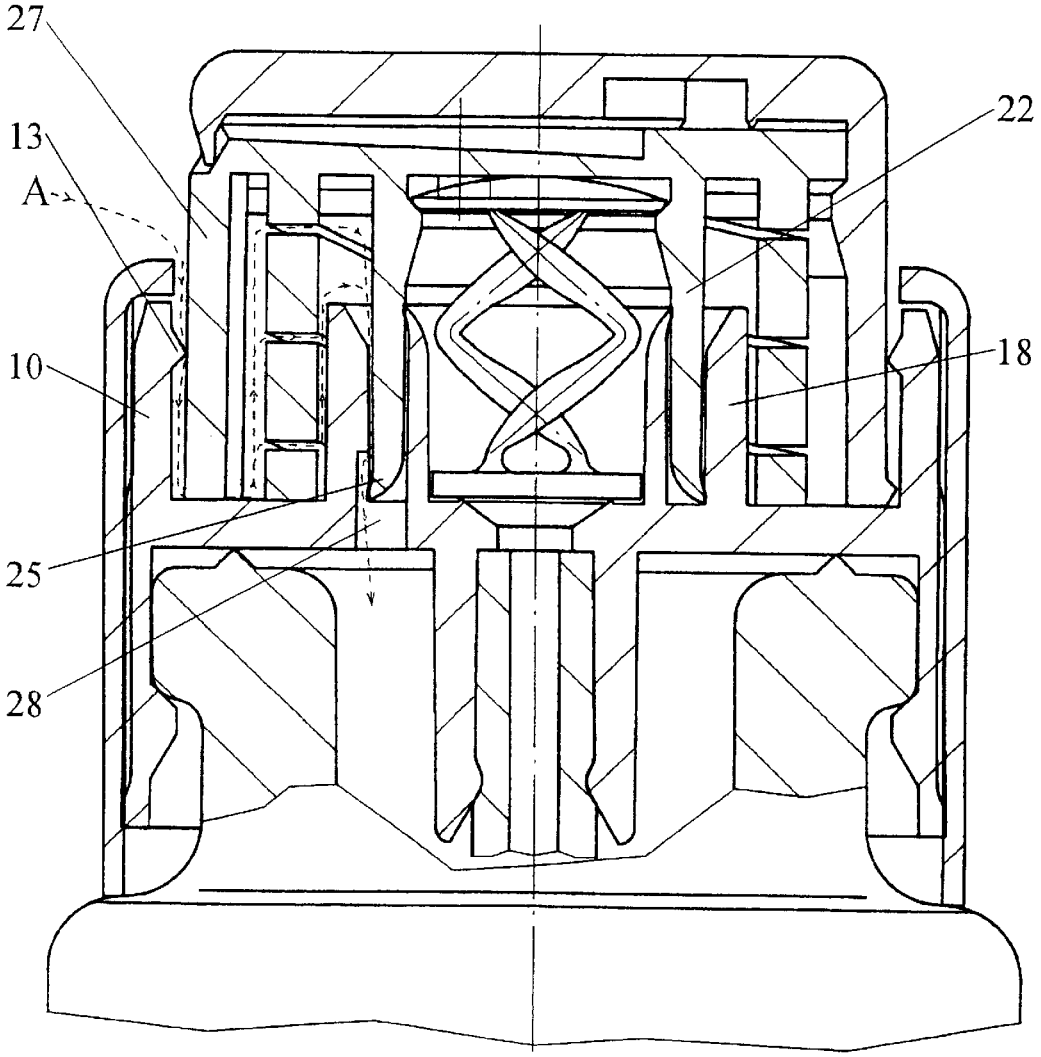
Figure 5:
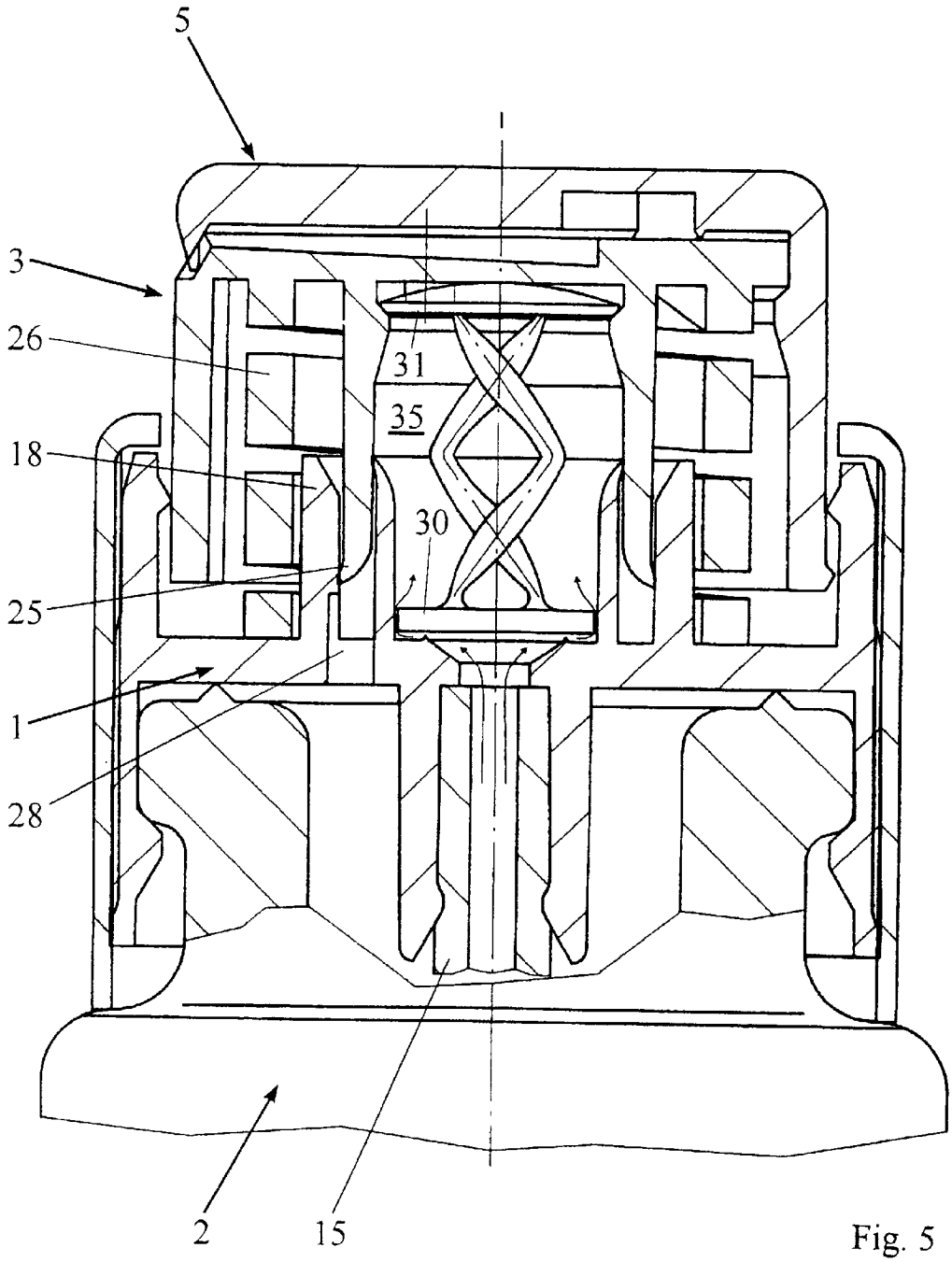
Figure 6:
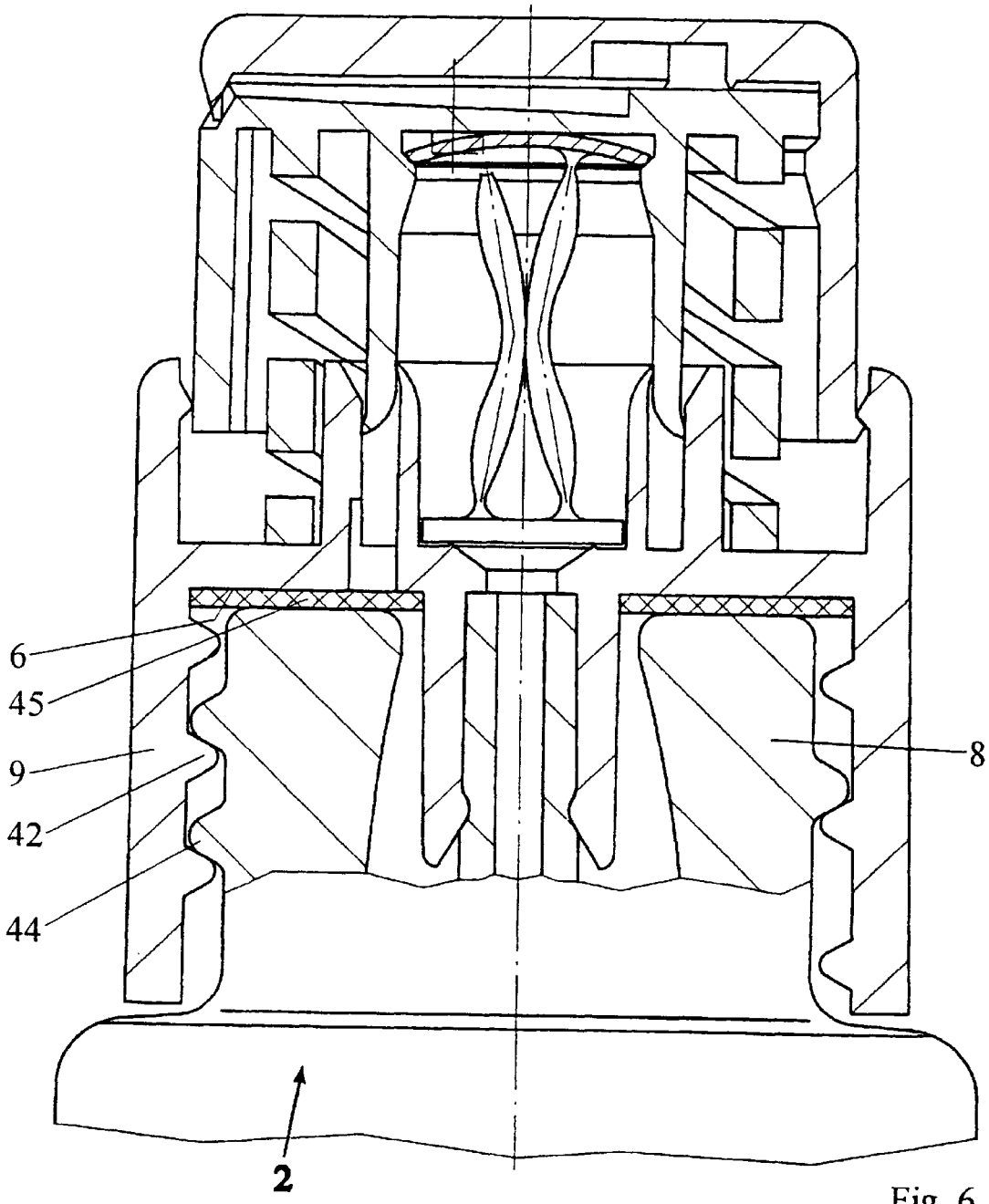
Figure 7:
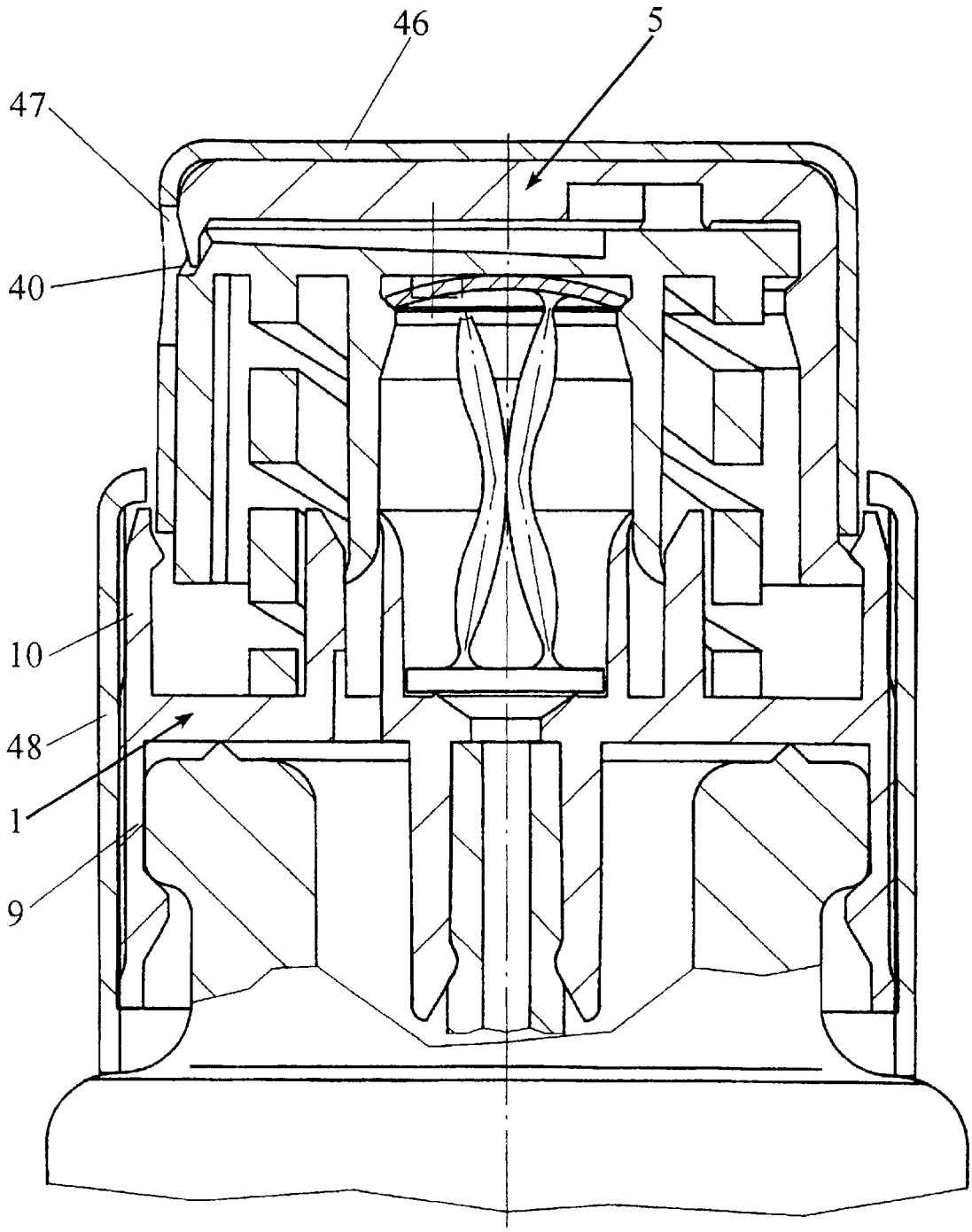
Figure 8:
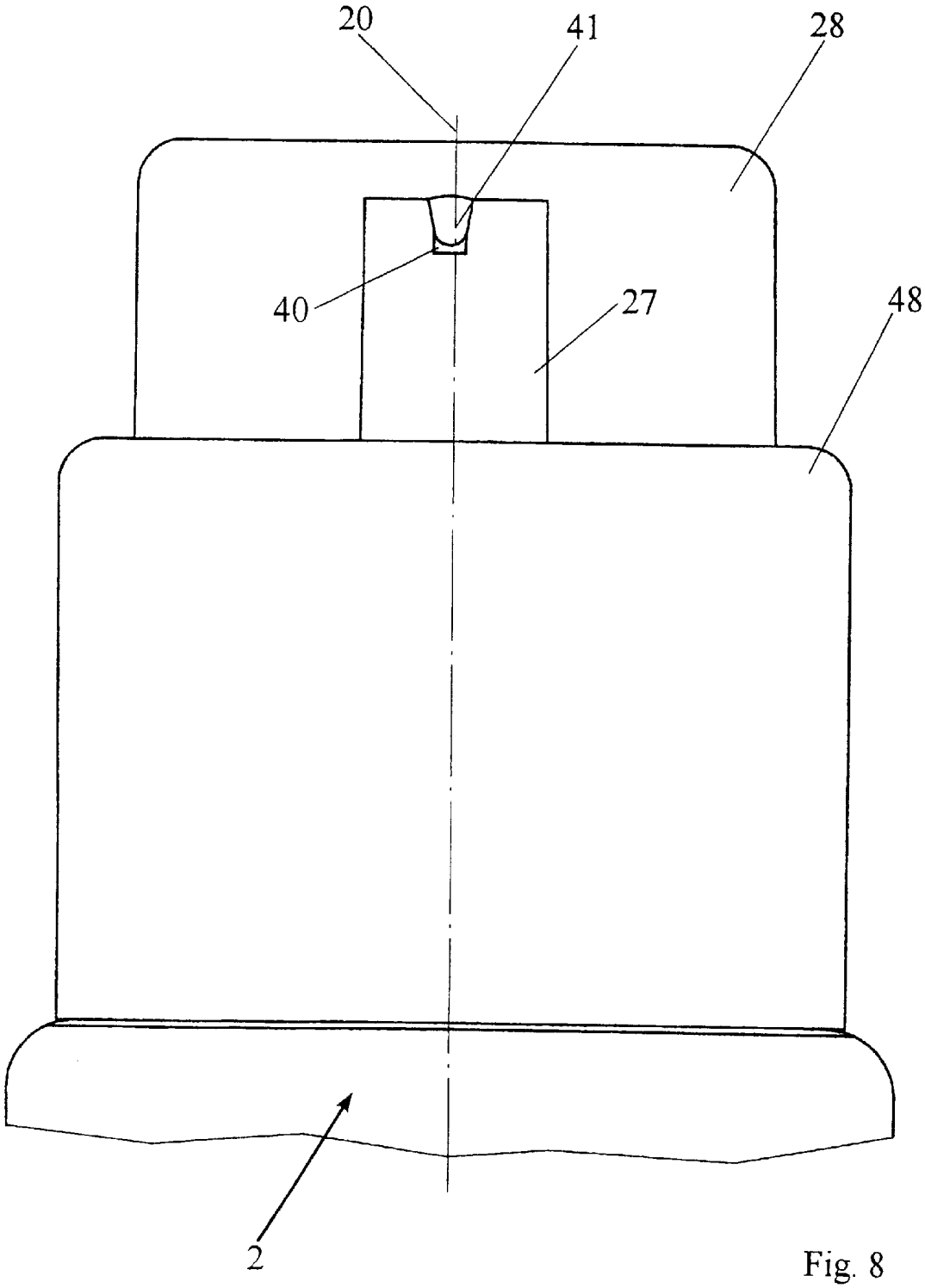
Figure 9:
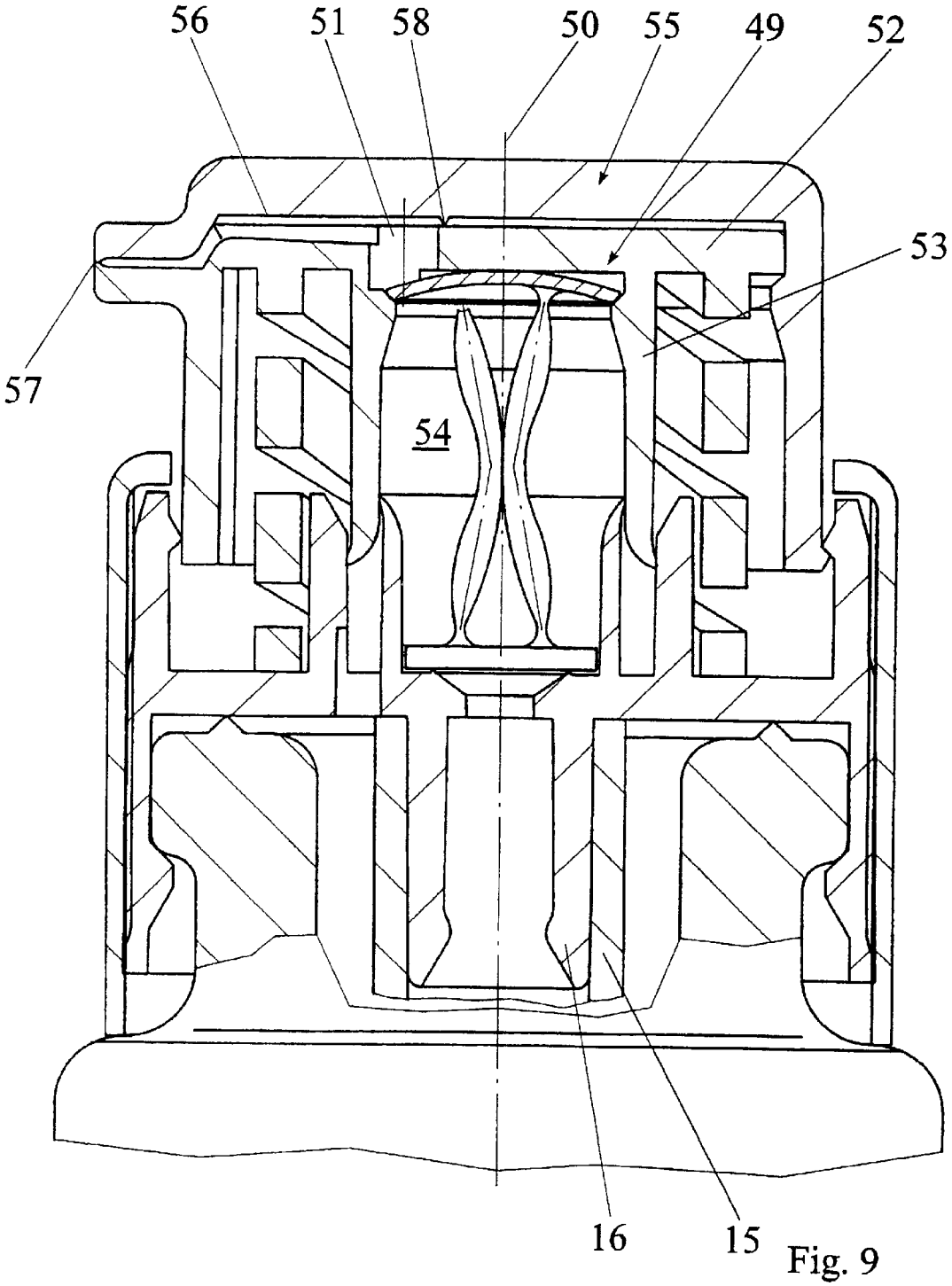
Figure 10:
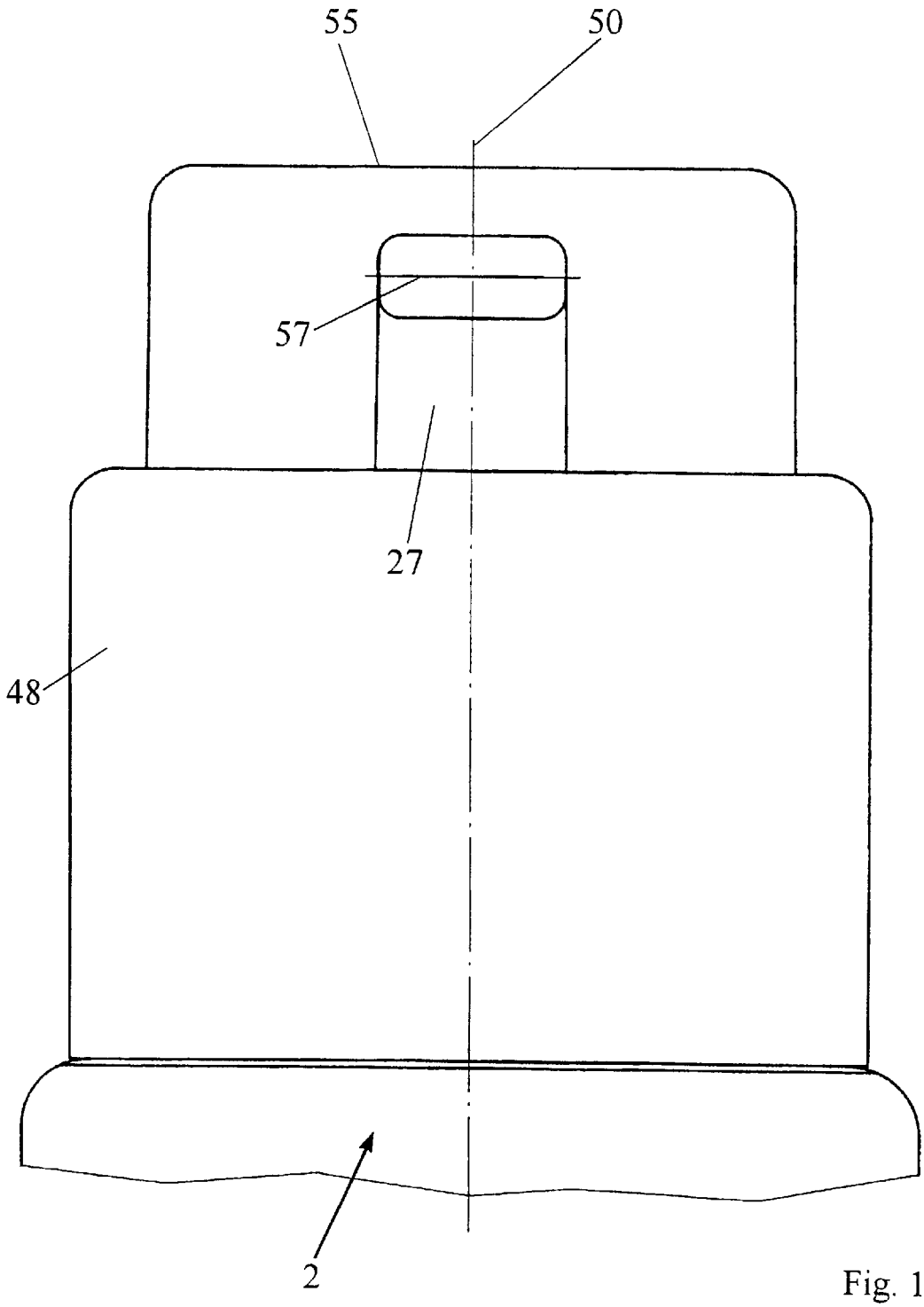

The figures show the following:

FIG. 1 A cross-sectional side view of a configuration of the pump according to the invention designed as a spray pump, in relieved condition, FIG. 2 The pump according to FIG. 1 when operated, FIG. 3 A section along Line III—III in FIG. 2, FIG. 4 The pump according to FIG. 1 in its limit position, FIG. 5 The pump according to FIG. 1 when relieved, FIG. 6 A cross-sectional side view of an alternative configuration of the pump according to the invention, FIG. 7 The pump according to FIG. 1 in a clad design, FIG. 8 A front view of the pump according to the invention, FIG. 9 A cross-sectional side view of an alternative configuration of the pump according to the invention, designed as a lotion pump, and FIG. 10 A front view of the pump according to FIG. 9.

The use of the terms "outwards" and "inwards" below relates to the longitudinal axis 20 of the pump. Outwards means in the direction facing away from longitudinal axis 20, while inwards means facing towards longitudinal axis 20. The terms "upwards" and "downwards" refer to the pump located on container 2. Downwards means the direction towards container 2, while upwards means the direction away from the container.

According to the drawing, the pump essentially comprises a base plate 1, which is secured to a container 2, a piston 3, a valve spring 4 located between base plate 1 and the piston, and a cap 5.

Base plate 1 consists of a cover-like segment which, when mounted, has a lower side 6 facing towards the container and an upper side 7 facing away from the container and which rests on the edge of a container sleeve 8 of container 2 to form a seal. In the region of the peripheral edge of lower side 6 of the base plate, the latter displays a container edge 9, running perpendicular to base plate 1 in the direction of container 2, and, on the upper side 7 of the base plate, a piston edge 10, running perpendicular to base plate 1 in the opposite direction to container 2. Container edge 9 and piston edge 10 are integrally moulded on base plate 1. Base plate 1 is preferably made of an injection-moulded plastic material.

At its lower end, container edge 9 displays a collar 11, running radially in the direction of container 2, on its inner side facing towards container 2. This collar 11 engages a recess 12 provided on the outer side of container sleeve 8. Base plate 1 can thus be connected to container 2 in snap-in fashion. The inner side of the upper end of piston edge 10 likewise displays a collar 13, which serves to fix piston 3 and cap 5 in place and to reduce the friction between these components when the pump is operated.

Above the centre of container sleeve 8, base plate 1 displays an inlet 14, through which the medium contained in container 2 can be transported from container 2 by means of the pump. In this context, the medium is sucked in from container 2 via a riser 15. Riser 15 is inserted in a riser sleeve 16, integrally moulded on the lower side 6 of the base plate around inlet 14 in the base plate, and is connected to the base plate to form a seal.

A cylindrical base plate sleeve 17 is integrally moulded on the upper side 7 of the base plate. This base plate sleeve 17 surrounds the inlet 14 in the base plate in the form of a circular ring. Moreover, also integrally moulded on the upper side 7 of the base plate is a guide sleeve 18, which is located at a distance from base plate sleeve 17 in the direction facing away from the longitudinal axis 20 of the pump in such a way that a circular annular gap 19 is formed between the outer surface of base plate sleeve 17 and the inner surface of the guide sleeve. This annular gap 19 serves to accommodate a sealing sleeve 22, described below.

Piston 3 displays a piston cover 21, which runs essentially transverse to the longitudinal axis 20 of the pump and has a lower side 21*a* of the piston, facing towards container 2, and an upper side 21*b* of the piston, facing away from the container. A cylindrical sealing sleeve 22 is integrally moulded on the lower side 21*a* of the piston. This sealing sleeve 22 surrounds a piston outlet 23 provided in the piston cover 21 in annular fashion. In the present case, piston outlet 23 is offset in relation to longitudinal axis 20 of the pump, but can be located at any point on piston cover 21 within sealing sleeve 22, depending on the field of application.

The diameter of sealing sleeve 22 is slightly larger than that of base plate sleeve 17 but, on the other hand, slightly smaller than that of guide sleeve 18. In this way, it is ensured that, when the pump is assembled, sealing sleeve 22 is connected to base plate sleeve 17 in sealing fashion in that it engages annular gap 19. Sealing sleeve 22 is guided by guide sleeve 18 on its outer side and by base plate sleeve 17 on its inner side. In order to improve the seal, both base plate sleeve 17 and the sealing sleeve are provided with lip seals 24, 25, running radially away from longitudinal axis 20 of the pump. Lip seal 24 of base plate sleeve 17 forms a seal against the inner surface of sealing sleeve 22 under pre-tension, while lip seal 25 of sealing sleeve 22 forms a seal against the inner side of guide sleeve 18 under pre-tension. The space enclosed by base plate sleeve 17 and sealing sleeve 22 forms a pump chamber 35.

Lower side 21*a* of the piston displays an integrally moulded spiral compression spring 26, which is located at a distance from sealing sleeve 22 in the radial direction away from the longitudinal axis 20 of the pump in such a way that it lies on the upper side 7 of the base plate at a distance from guide sleeve 18 in the radial direction away from the longitudinal axis 20 of the pump. The present compression spring 26 is of double design in order to obtain a higher spring power with a compression spring 26 of short length. The spring can also be of single design if a greater overall height of the pump is acceptable.

Moreover, a cladding element 27, running downwards, is integrally moulded on the outer edge of lower side 21*a* of the piston. This cladding element 27 serves to provide axial guidance of piston 3 during operation and assembly of the pump with the cap and clads the pump. The lower end of cladding element 27 lies against collar 13.

Piston 3 is operated via a cap 5, which is fitted on piston 3 and surrounds it in the manner of a cover. For fixing in place, cap 5 is connected by a snap fit to collar 13 via a bead 29, which is integrally moulded on cap 5 and runs radially outwards. This snap-fit connection prevents unintentional detachment of the pump from container 2. Cap 5 is provided with a recess designed to accommodate cladding element 27.

Valve spring 4 displays a sealing bottom plate 30 which lies on the inlet 14 in the base plate, a sealing top plate 31 which lies on a support emerging radially relative to the longitudinal axis 20 of the pump, and two torsion springs 32, 33, integrally moulded between bottom plate 30 and the top plate. The support is designed as an annular collar 34, integrally moulded on the upper end of the inner side of sealing sleeve 22.

The outside diameter or the dimensions of bottom plate 30 is or are slightly smaller than the inside diameter of base plate sleeve 17, meaning that bottom plate 30 is capable of slight movement relative to base plate sleeve 17, but is also guided by base plate sleeve 17 at the same time. In order to increase the sealing effect between bottom plate 30 and base plate 1, the upper side of the base plate displays a sealing film 59, which is located around the inlet 14 in the base plate and is integrally moulded on the base plate.

Top plate 31 is arched upwards. The zenith of the arch of top plate 31 is in contact with lower side 21*a* of the piston. The arch clamps top plate 31 between lower side 21*a* of the piston and the support. In this way, top plate 31 forms a seal with the support. As a result, an air-tight pump chamber 35 is formed in the space between bottom plate 30, top plate 31, base plate sleeve 17 and sealing sleeve 22.

The outside diameter of top plate 31 is smaller than the inside diameter of sealing sleeve 22 in the region above the support. This ensures that the edge of top plate 31 can be lifted off the support when pressure develops inside pump chamber 35.

FIG. 1 illustrates the pump in its starting position, in which compression spring 26 is relaxed. The individual steps of pump operation are illustrated in FIGS. 2 to 5. The pump chamber is already filled with medium at the start of the sequence described below. The direction of flow of the medium is indicated by arrows.

In FIG. 2, an external force is applied to cap 5. The piston is pressed downwards against the force of compression spring 26 and torsion springs 32, 33. At this time during the relative motion of piston 3 in relation to base plate 1, lip seal 24 for the medium lies in sealing fashion against the inner wall of sealing sleeve 22, and lip seal 25 lies in sealing fashion against the inner wall of guide sleeve 18. The pressure inside pump chamber 35 lifts top plate 31 upwards and off collar 34. The medium can now escape from pump chamber 35 and is transported from pump chamber 35 to piston outlet 23 through an annular gap forming between top plate 31 and collar 34. At the same time, torsion springs 32, 33 and the pressure in the pump chamber press bottom plate 30 onto sealing film 59, so that the medium cannot flow back into container 2.

As can be seen from FIG. 3, in particular, when the medium leaves piston outlet 23, it flows into duct 36, which is integrally moulded in upper side 21*b* of the piston and is designed in such a way as to increase the flow velocity of the medium. To this end, duct 36 is initially designed as an essentially semi-circular curved path, the narrowest radius of which is located at point 37. The medium is accelerated by centrifugal force as a result of this design of duct 36.

In the area downstream of point 37 with the narrowest radius, duct 36 displays a deflector wall 38, which runs essentially perpendicular to the direction of flow of the medium flowing through the duct. In the case of liquid media, this deflector wall 38 causes droplet formation, as the cohesion of the substance is partially overcome as a result of the impact of the medium on the deflector wall. The direction of flow of the medium is redirected downwards by deflector wall 38.

The medium now enters a linear segment 39 formed within the upper side 21*b* of the piston. To be precise, this linear segment 39 is formed partly in the upper side 21*b* of the piston and partly in the lower side of cap 5, which together form linear segment 39 when assembled. The cross-section of linear segment 39 decreases towards outlet aperture 40, having its smallest cross-section at outlet aperture 40. This design of the duct once again increases the flow velocity of the medium.

Outlet aperture 40 is sealed off by sealing lip 41, which projects downwards and is integrally moulded on the lower side of cap 5. The pressure of the medium generated when operating the pump forces this elastically designed sealing lip to the side, allowing the medium to escape. In addition, sealing lip 41 once again provides for the atomisation of liquid media.

FIG. 4 shows the pump in its limit position, i.e. the pump is pressed all the way down. In this position, no more medium flows out of outlet aperture 40. Bottom plate 30 again lies against inlet 14 in the base plate to form a seal, and top plate 31 lies against collar 34 to form a seal. Lip seal 25 of the sealing sleeve protrudes into air aperture 28, meaning that there is no longer a sealing fit between lip seal 25 and the inner side of guide sleeve 18. At this stage, ambient air flows into the pump between collar 13 of piston edge 10 and cladding element 27, flowing from there through the gap between the lower side of cladding element 27 and upper side 6 of the base plate, through compression spring 26, between cladding element 27 and sealing sleeve 22 into air aperture 28 and thus into container 2, this resulting in equalisation of the pressure in the container. The path of the air is indicated by arrow A in FIG. 4.

FIG. 5 shows the pump during relief of the pressure. Compression spring 26 forces piston 3 and cap 5 back into their starting position. Lip seal 25 again lies against the inner side of guide sleeve 18 to form a seal, having moved out of the area of air aperture 28. A vacuum develops in pump chamber 35 during the upward relative motion of piston 3 in relation to base plate 1. This vacuum lifts bottom plate 30, with the result that medium is sucked from container 2, through riser 15 and into pump chamber 35. In this way, pump chamber 35 is filled and is again ready for operation for a further pump cycle. If pump chamber 35 contains no medium when used for the first time, it is first filled by operating the pump several times.

FIG. 6 shows an alternative configuration of the pump. The design of the pump essentially corresponds to that of the pump illustrated in FIGS. 1 to 5. In contrast to the latter, the configuration illustrated here is designed as a screw-type version. On the inner side of container edge 9, the pump displays an integrally moulded female thread 42, which engages an integrally moulded male thread 44 on the outer side of container sleeve 8, which corresponds to female thread 42. In addition, this configuration displays an elastic packing ring 45, located between the container edge and lower side 6 of the base plate, which maintains the necessary pre-tension in order to prevent unintentional detachment of the pump from container 2.

FIG. 7 illustrates another configuration of the pump according to the invention. This essentially corresponds to the clamp-type version illustrated in FIGS. 1 to 5. In contrast to the latter, the pump is additionally provided with a cover cap 46. This cover cap covers cap 5 and is preferably made of aluminium, which is particularly resistant to numerous media, such as perfume, hairspray and the like. Moreover, it is inexpensive to manufacture. In the area of outlet aperture 40, cover cap 46 is provided with a hole 47, through which the medium can escape unhindered. In order to be certain not to obstruct the flow of medium, hole 47 is preferably substantially larger than outlet aperture 40. Moreover, the pump can be provided with a ring 48, located on the outer sides of container edge 9 and piston edge 10 of base plate 1, which is preferably made of the same material as cover cap 46 and likewise serves to protect the pump against aggressive media, as well as to improve the styling.

FIG. 8 shows a front view of outlet aperture 40 of the pump from FIG. 7.

The pump illustrated in FIGS. 9 and 10 represents an alternative configuration of the pump, designed as a lotion pump. A lotion is a viscous medium which does not need to be transported from the pump under such high pressure and which thus also does not need to be accelerated. In addition, atomisation is not required. The pump can, of course, also be used for other viscous media.

The essential difference in comparison with the configurations illustrated in the preceding figures, which can also be referred to as spray pumps, lies in the design of the duct between the cap and the piston, as well as the different design of the outlet aperture.

Piston 49 is provided with a piston outlet 51, located at a position offset relative to the longitudinal axis 50 of the pump. This piston outlet 51 is located in the area of piston cover 52, which is positioned within sealing sleeve 53, integrally moulded on the lower side of piston 49.

During pumping, the lotion passes from pump chamber 54 into duct 56, formed between the lower side of cap 55 and the upper side of piston 49. This duct takes the lotion direct ly to the outlet aperture, designed in the form of a slit-type nozzle, without passing via an acceleration chamber.

In the region of the outlet aperture, the adjacent areas of cap 55 and piston 49 are designed in such a way that a fine slit-type nozzle is formed between them. Duct 56 leads to slit 57 of the slit-type nozzle in essentially conical form. The slit-type nozzle is sealed off when the pump is not in operation, so that no bacteria can enter and the lotion is protected against drying out. When the pump is operated, slit 57 is easily opened by the internal pressure of the lotion, allowing the latter to escape.

The slit-type nozzle design according to the invention is far more favourable than that known from the prior art, where very close manufacturing tolerances have to be observed in the transition area from the cap to the slit-type nozzle integrally moulded on it, this making production highly complicated and expensive. For example, a steel core with a diameter of 0.75 mm is required for injection moulding of the plastic parts. In the invention, on the other hand, the slit-type nozzle is formed by assembling two prefabricated parts.

This is far more simple and requires no special manufacturing tolerances.

In order to prevent the lotion entering areas not intended for this purpose between cap 55 and piston 49 during pumping, a sealing film 58 is integrally moulded around duct 56 and piston outlet 51 on the lower side of cap 55, which makes contact with the upper side of piston 49. Sealing films of this kind can also be provided in the configuration illustrated in FIG. 1.

As also clearly indicated by FIG. 9, riser 15 can also be slipped onto riser sleeve 16 from the outside.

FIG. 10 shows a front view of the pump from FIG. 9, looking towards the slit-type nozzle.

All the pump configurations illustrated in the figures are essentially rotationally symmetrical, cylindrical configurations, which are rotationally symmetrical about longitudinal axis 20 of the pump. However, it is also within the scope of the invention to design certain components in a position offset from the centre line 20 of the pump, i.e. to design the pump and container 2 in non-rotationally symmetrical form and to make provision for other geometries.

The individual components are preferably injection-moulded from a plastic material, meaning that their production is particularly simple and inexpensive. Some of the components can also be made of metal or other suitable materials, provided that they do not require the elasticity of a plastic.

The pump configuration according to the invention greatly simplifies the design of the pump. Compared to the prior art, only three or four parts are required instead of the previous eight parts and more. The design according to the invention reduces the overall height, so that the pump can be located entirely in the area above the base plate. This permits its use on containers whose aperture cross-section is small and limited. Really, all that is now required is a aperture cross-section of the container that is sufficient to insert the riser. As all the pump components can be injection-moulded from a plastic material, their manufacture is particularly simple and inexpensive. In addition, disposal is also facilitated. The pump can be operated with and without the cap. The design of the duct as an acceleration chamber in accordance with the invention makes it possible to dispense with additional nozzles for accelerating and atomising liquid media. These nozzles represent expensive individual parts in the prior art. In the non-air-aspirating configuration of the pump according to the invention, the container is expediently made of an elastic material.

What is claimed is:

1. A pump for dispensing flowable media comprising a base plate (1), means (11, 42) for securing the base plate (1) to a container, a base plate sleeve (17) projecting from said base plate (1) and surrounding an inlet (14) in said base plate (1), a piston (3, 49) carrying a sleeve (22, 53) disposed in relative telescopic sliding relationship to said base plate sleeve (17) and in part defining therewith a pump chamber (35, 54), an outlet (23, 51) for dispensing flowable media from said pump chamber (35, 54), first spring means (26) for returning said piston (3, 49) from a decompressed condition thereof, a valve mechanism (30–33) housed substantially within said pump chamber (35, 54), said valve mechanism (30–33) including first and second sealing plates (30, 31, respectively) disposed for selectively opening and closing flowable media communication with respect to said inlet (14) and said outlet (23, 51), and at least one further spring means (32 and/or 33) associated with said sealing plates (30, 31) for normally biasing the sealing plates (30, 31) to positions closing-off flowable media communication through the respective inlet (14) and outlet (23, 51).

2. The pump as defined in claim 1 wherein said first spring means (26) is disposed between said base plate (1) and a piston cover (21) of said piston (3, 49) spaced from said base plate (1).

3. The pump as defined in claim 1 wherein said first spring means (26) is disposed between said base plate (1) and a piston cover (21) of said piston (3, 49) spaced from said base plate (1), and said first spring means (26) is in external relationship to said base plate sleeve (17) and said piston sleeve (22, 53).

4. The pump as defined in claim 1 wherein said first spring means (26) is disposed between said base plate (1) and a piston cover (21) of said piston (3, 49) spaced from said base plate (1), and said first spring means (26) is in external telescopic relationship to said base plate sleeve (17) and said piston sleeve (22, 53).

5. The pump as defined in claim 1 wherein said first spring means (26) is an integral molded portion of said piston (3, 49).

6. The pump as defined in claim 1 including a guide sleeve (18) projecting away from said base plate (1) and being in radially spaced relationship to said base plate sleeve (17), and said piston sleeve (22, 53) being disposed in sliding relationship between said guide sleeve (18) and said base plate sleeve (17).

7. The pump as defined in claim 1 including a guide sleeve (18) projecting away from said base plate (1) and being in radially spaced relationship to said base plate sleeve (17), said piston sleeve (22, 53) being disposed in sliding relationship between said guide sleeve (18) and said base plate sleeve (17), and means (24) of said base plate sleeve (17) for creating a seal between said base plate sleeve (17) and said piston sleeve (22, 53).

8. The pump as defined in claim 1 including means (24) of said base plate sleeve (17) for creating a seal between said base plate sleeve (17) and said piston sleeve (22, 53).

9. The pump as defined in claim 1 including a guide sleeve (18) projecting away from said base plate (1) and being in radially spaced relationship to said base plate sleeve (17), said piston sleeve (22, 53) being disposed in sliding relationship between said guide sleeve (18) and said base plate sleeve (17), and means (25) of said piston sleeve (22, 53) for creating a seal between said piston sleeve (22, 53) and said guide sleeve (18).

10. The pump as defined in claim 1 including a guide sleeve (18) projecting away from said base plate (1) and being in radially spaced relationship to said base plate sleeve (17), said piston sleeve (22, 53) being disposed in sliding relationship between said guide sleeve (18) and said base plate sleeve (17), means (25) of said piston sleeve (22, 53) for creating a seal between said piston sleeve (22, 53) and said guide sleeve (18), and means (24) of said base plate sleeve (17) for creating a seal between said base plate sleeve (17) and said piston sleeve (22, 53).

11. The pump as defined in claim 1 including aperture means (28) in said base plate (1) outboard of said base plate sleeve (17) for effecting air flow therethrough during actuation of said dispenser in association with a container adapted to house dispensable flowable media.

12. The pump as defined in claim 1 including a guide sleeve (18) projecting away from said base plate (1) and being in radially spaced relationship to said base plate sleeve (17), said piston sleeve (22, 53) being disposed in sliding relationship between said guide sleeve (18) and said base plate sleeve (17), and aperture means (28) in said base plate (1) between said base plate sleeve (17) and said guide sleeve (18) for effecting air flow therethrough during actuation of said dispenser in association with a container adapted to house dispensable flowable media.

13. The pump as defined in claim 1 including an integrally molded duct (36) in an outer surface of a piston cover (5, 55) of said piston (3, 49), and said duct (36) being in fluid communication with said outlet (23, 51).

14. The pump as defined in claim 1 including an integrally molded duct (36) in an outer surface of a piston cover (5, 55) of said piston (3, 49), said duct (36) being in fluid communication with said outlet (23, 51), and said duct (36) includes a substantially arcuate path portion (37) adjacent said outlet (23, 51).

15. The pump as defined in claim 1 including an integrally molded duct (36) in an outer surface of a piston cover (5, 55) of said piston (3, 49), said duct (36) being in fluid communication with said outlet (23, 51), and said duct (36) includes an exit duct portion (39) remote from said outlet (23, 51) and converging in the direction of media flow.

16. The pump as defined in claim 1 including an integrally molded duct (36) in an outer surface of a piston cover (5, 55) of said piston (3, 49), said duct (36) being in fluid communication with said outlet (23, 51), said duct (36) includes a substantially arcuate path portion (37) adjacent said outlet (23, 51), and said arcuate path portion (37) blends into an exit duct portion (39) remote from said outlet (23, 51) and converging in the direction of media flow.

17. The pump as defined in claim 1 including an integrally molded duct (36) in an outer surface of a piston cover (5, 55) of said piston (3, 49), said duct (36) being in fluid communication with said outlet (23, 51), and a deflector wall portion (38) in said duct (36) disposed substantially normal to the direction of media flow.

18. The pump as defined in claim 1 including a piston cover (5, 55) carried by said piston (3, 49).

19. The pump as defined in claim 1 including a piston cover (5, 55) carried by said piston (3, 49), said piston (3, 49) and piston cover (5, 55) having opposing surfaces, and duct means (36) defined by said opposing surfaces for effecting media flow from said outlet (23, 51).

20. The pump as defined in claim 1 including a piston cover (5, 55) carried by said piston (3, 49), said piston (3, 49) and piston cover (5, 55) having opposing surfaces, duct means (36) defined by said opposing surfaces for effecting media flow from said outlet (23, 51), said duct means (36) terminate at an outlet aperture (40) remote from said outlet (23, 51), and said piston cover (5, 55) includes means (41) for sealing said outlet aperture (40).

21. The pump as defined in claim 1 including an integrally molded duct (36) in an outer surface of a piston cover (5, 55) of said piston (3, 49), said duct (36) being in fluid communication with said outlet (23, 51), and said duct (36) terminating in a slit-type nozzle defined by opposing surfaces of said piston cover (5, 55) and said piston (3, 49).

22. The pump as defined in claim 1 wherein said at least one further spring means (32 and/or 33) includes a torsion spring.

23. The pump as defined in claim 1 wherein said at least one further spring means (32 and/or 33) includes a torsion spring integrally molded with said first and second sealing plates (30, 31, respectively).

24. The pump as defined in claim 1 wherein said first spring means (26) is a compression spring.

25. The pump as defined in claim 1 wherein said first spring means (26) is a compression spring, and said at least one further spring means (32 and/or 33) is a torsion spring.

26. The pump as defined in claim 1 wherein said first spring means (26) is a compression spring, and said at least one further spring means (32 and/or 33) is a torsion spring integrally molded with said first and second sealing plates (30, 31, respectively).

27. The pump as defined in claim 1 wherein said outlet opening and closing second sealing plate (31) has an exterior diameter less than an interior diameter of said piston sleeve (22, 53).

28. The pump as defined in claim 1 wherein said outlet opening and closing second sealing plate (31) has an exterior diameter less than an interior diameter of said piston sleeve (22, 53), and said outlet opening and closing second sealing plate (31) is concavely curved with respect to said inlet opening and closing first sealing plate.

29. The pump as defined in claim 1 wherein said outlet opening and closing second sealing plate (31) has an exterior diameter less than an interior diameter of said piston sleeve (22, 53), and means (34) of said piston sleeve (22, 53) for supporting a periphery of said outlet opening and closing second sealing plate (31).

* * * * *